US005669244A

United States Patent [19]

Okuno

[11] Patent Number: 5,669,244

[45] Date of Patent: Sep. 23, 1997

[54] BINDING OFF METHOD WITH USE OF A FLAT KNITTING MACHINE AND A KNIT FABRIC THUS BOUND OFF

[75] Inventor: Masao Okuno, Wakayama, Japan

[73] Assignee: Shima Seiki Manufacturing Ltd., Wakayama, Japan

[21] Appl. No.: 628,107

[22] Filed: Apr. 9, 1996

[30] Foreign Application Priority Data

Apr. 10, 1995 [JP] Japan ..... 7-083695

[51] Int. Cl.[6] ..... D04B 1/00

[52] U.S. Cl. ..... 66/64; 66/172 R; 66/176

[58] Field of Search ..... 66/64, 172 R, 66/176

[56] References Cited

U.S. PATENT DOCUMENTS

| | | | |
|---|---|---|---|
| 4,548,057 | 10/1985 | Essig | 66/172 R |
| 5,257,514 | 11/1993 | Okuno | 66/64 |
| 5,259,207 | 11/1993 | Mitsumoto | 66/64 |
| 5,271,249 | 12/1993 | Mitsumoto et al. | 66/176 X |
| 5,377,507 | 1/1995 | Shima | 66/172 R X |
| 5,417,088 | 5/1995 | Nakai | 66/172 R X |
| 5,444,995 | 8/1995 | Benetton | 66/64 |
| 5,456,096 | 10/1995 | Mitsumoto et al. | 66/172 R |
| 5,467,616 | 11/1995 | Loquet et al. | 66/172 R X |
| 5,537,843 | 7/1996 | Okuno | 66/64 |

*Primary Examiner*—John J. Calvert
*Attorney, Agent, or Firm*—Nikaido Marmelstein Murray & Oram LLP

[57] ABSTRACT

A binding off method for binding off stitches of at least two fabrics which form a tube requires a plurality of steps. A first step is providing a flat knitting machine with a first needle bed and a second needle bed, with each needle bed having a plurality of needles, and being slidable relative to each other. The needle beds are configured to hold stitches, with the stitches being transferable between the first and second needle bed. A second step is knitting a first knit fabric and a second knit fabric, with the first knit fabric corresponding to the first needle bed and the second knit fabric corresponding to the second needle bed. The first and second knit fabrics are configured to face each other on the first and second needle beds. A third step is overlapping a stitch of the first fabric and a stitch of the second fabric by holding a first stitch of the first fabric on a needle of the second needle bed, holding a second stitch of the second knit fabric on a needle of the first needle bed, and holding a third stitch as a binding off stitch on a needle of one of the first and second needle beds. At least one of the above three stitches is transferred between the first needle bed and the second needle bed. The first, second, and third stitches are alternately overlapped with each other to form a triple stitch. A fourth stitch is formed on the needle of the one of the first and second needle beds upon which the triple stitch is held. A triple stitch is then removed from the needle bed upon which it is held, and the first, second, and third stitches of the triple stitch are rotated to suppress a protrusion formed by the binding off of the triple stitch. The overlapping step, the step of forming the fourth stitch, and the removal and rotation steps are repeated.

7 Claims, 15 Drawing Sheets

BINDING OFF METHOD WITH USE OF A FLAT KNITTING MACHINE AND A KNIT FABRIC THUS BOUND OFF

FIELD OF THE INVENTION

This invention relates to a binding off treatment for both connecting the final courses of a pair of knit fabrics and serging the connection.

PRIOR ART

A conventional method for serging the stitches of a final course of a knit fabric is provided by the method disclosed in the Japanese Provisional Patent Publication No. SHO59-21758 (U.S. Pat. No. 4,548,057. DE 3203028C). According to the official gazette, a stitch of the final course of a knit fabric is made to overlap with a stitch held on an adjacent needle of the needle bed, and the yarn is fed to the needle holding both the stitches to newly form a stitch in the next knitting course. Next, the newly formed stitch is made to overlap with a stitch held on an adjacent needle, then the yarn is fed to the needle holding both the stitches to form a stitch in the next knitting course. These processes are repeated for each of the stitches of the final course sequentially to achieve serging. This method is normally called binding off.

The above-mentioned binding off method may be used to bind off overlapped stitches of the final courses of a pair of fabrics knit on a front needle bed and a rear needle bed. In this way, both the knit fabrics are connected with each other and the stitches of their respective final courses are serged. According to this method, suppose, for example, a front body is formed on a front bed and a back body is formed on a rear bed. After that, the stitches of the final courses of the front shoulders formed in the upper part of the front body and those of the back shoulders formed in the upper part of the back body are made to overlap with each other, and binding off is effected. As a result, the front body and the back body are connected with each other at the shoulders. According to this method, however, as shown in FIG. 16, a stitch 102 of the final course of the front shoulder 101 and a stitch 104 of the final course of the back shoulder 103 are made to overlap each other in such a way that the backs of the respective stitches are in contact with each other, and a stitch 105 for binding off is formed on the overlapped stitches. Since the stitch 102 of the final course of the front shoulder 101 and the stitch 104 of the final course of the back shoulder 103 are overlapped in the above-mentioned manner, the top portions of the knit fabrics tend, as shown in FIG. 16, to protrude from the surfaces of the knit fabrics at the joint of these fabrics. FIG. 16 is a sectional view of a joint of the front shoulder and the back shoulder.

To solve the above-mentioned problem, the method of Japanese Provisional Patent Publication No. HEI4-209855 (U.S. Pat. No. 5,456,096, EP 468687B) has been proposed. According to this method, a front body and a back body are knitted by using a front needle bed and a rear needle bed. After that, the yarn feeder used for knitting the front body and the yarn feeder used for knitting the back body are shifted to cross the respective yarns prolonged between the knit fabrics and the yarn feeders. Under this condition, stitches of the respective final courses of the front body and the back body are bound off sequentially to connect the front body and the rear body by means of said crossed yarns. In a pair of fabrics bound off by this method, the stitches of the front body and those of the back body are not overlapped with each other. Hence the pair of fabrics is free of such problems as stiffing and protrusion of the bound-off portions marring the finished knit fabric in comparison with a fabric wherein the front body and the back body are overlapped with each other. To achieve binding off, this method, however, requires the use of a plurality of yarn feeders to knit the front body and the back body.

SUMMARY OF THE INVENTION

One objective of the present invention is to provide a binding off method that prevent protrusion of bound-off portions and connect two fabrics flat.

Another objective of the present invention is to make the stitches, which are used for binding off and differ in the wale direction from others, kept concealed from the face of the finished fabric.

Still another objective of the present invention is to prevent stitches from being twisted at the bound-off portions.

According to the present invention, a flat knitting machine is used, which is provided at least a first needle bed and a second needle bed each having a large number of needles, said needle beds are slidable relative to each other, and in which stitches can be transferred between said needle beds, a first knit fabric is knitted so that the first knit fabric belongs to the first needle bed, and a second knit fabric is knitted so that the second knit fabric belongs to the second needle bed, both knit fabrics facing to each other, after that, stitches of the first knit fabric and those of the second knit fabric are made to overlap each other and they are bound off. Such a flat knitting machine is well known, and the concept of binding off itself is also well known. Knitting of the fabrics may be plain knitting, rib knitting, etc. In the case of plain knitting, the first knit fabric is literally formed on the first needle bed and belongs to the first needle bed, and the second knit fabric is formed on the second needle bed and belongs to the second needle bed. In the case of rib knitting, one can freely determine which knit fabric belongs to which needle bed. For example, in the case of a flat knitting machine with two needle beds, if rib knitting is used, transfer of knit fabrics between the needle beds will be made frequently, and one knit fabric will be held on the first needle bed and the other knit fabric will be held on the second needle bed. By paying attention to these conditions, one can determine which knit fabric belongs to which needle bed. Accordingly, in the course of knitting, it is not necessarily the case that the first knit fabric is knitted on the first needle bed and the second knit fabric is knitted on the second needle bed. Prior to binding off, however, the stitches of the first knit fabric are arranged on the first needle bed, and the stitches of the second knit fabric are arranged on the second needle bed.

The present invention is characterized by the steps of:

holding at least one stitch of the first knit fabric on a needle of the second needle bed, at least one stitch of the second knit fabric on a needle of the first needle bed and at least a stitch for binding off on a needle of either the first or the second needle bed, then, transferring at least two of the three stitches of the said stitch held on the first needle bed and said stitch held on the second needle bed and the stitch for binding off between the needle beds, so that the three stitches are overlapped one by one with each other to form a triple stitch held one of the first and second needle beds, and then, forming a new stitch for binding off the triple stitch, removing said triple stitch from the needle bed holding the triple stitch so that the stitches in said triple stitches are relatively turned.

Preferably, a stitch at one end of the first knit fabric is held on the second needle bed, and a stitch at the end on the same side of the second knit fabric is held on the first needle bed, then, by transferring between the needle beds, said two stitches are overlapped with each other, after that, a first stitch for binding off is formed on the overlapped stitches, then, said first stitch for binding off, a stitch adjacent to said stitch at the end of the first knit fabric, and a stitch adjacent to said stitch at the end of the same side of the second knit fabric are overlapped with each other to form the said triple stitch.

Further preferably, are repeated the following steps said new stitch for binding off, a stitch adjacent to said triple stitch on the first knit fabric, and a stitch adjacent to said triple stitch on the second knit fabric are overlapped with each other to form a new triple stitch, and a new stitch for binding off is formed on the new triple stitch.

Preferably, are repeated the following steps one stitch of the first knit fabric is transferred to and held on the second needle bed, and this stitch, one stitch of the second knit fabric held on the first needle bed, and a stitch for binding off are overlapped with each other to form a triple stitch, and said new stitch for binding off is formed on said triple stitch.

Preferably, stitches of the second knit fabric are formed and held on the first needle bed.

Preferably, after the completion of binding off of the first and second knit fabrics, each of the triple stitches has an order of an outermost stitch being at the outermost, a middle stitch being in the middle, and an innermost stitch being at the innermost, and the stitch for binding off in the middle or the innermost position of the triple stitch.

Preferably, at least one of said at least one stitch of the first knit fabric and said at least one stitch of the second knit fabric is formed in a twisted condition before the formation of a triple stitch.

Preferably, are repeated the following steps one stitch of said first knit fabric is transferred to the second needle bed, and one stitch of said second knit fabric is transferred to the first needle bed, and then, these transferred stitches are overlapped with said stitch for binding off to form said triple stitch and a new stitch for binding off is formed on the triple stitch.

Preferably, are repeated the following steps a plurality of stitches of the second knit fabric including the stitch at one end thereof are transferred to the first needle bed, then, the stitch at the end of the same side of the first knit fabric is transferred to the second needle bed, then, the stitch at said end of the first knit fabric and the stitch at said end of the second knit fabric are overlapped with each other to form a double stitch, then, a stitch is formed on this double stitch to form said stitch for binding off, and a new stitch is formed on a stitch among the transferred stitches of the second knit fabric and being adjacent to said double stitch, and then, said stitch for binding off and said new stitch are overlapped with each other to form a new double stitch, a stitch of the first knit fabric opposing to said new stitch is newly transferred to the second needle bed, then, said newly transferred stitch and said new double stitch are overlapped with each other to form a new triple stitch, a new stitch for binding off is formed on said new triple stitch, and a new stitch is formed on a stitch which is among the transferred stitches of the second knit fabric and is adjacent to said new triple stitch.

Preferably, the following steps are repeated:

a plurality of stitches of the second knit fabric including the stitch at one end thereof are transferred to the first needle bed, then, the stitch at the end of the same side of the first knit fabric is transferred to the second needle bed, then, the stitch at said end of the first knit fabric and the stitch at said end of the second knit fabric are overlapped with each other to form a double stitch, then, a new stitch is formed on a stitch which is among the transferred stitches of the second knit fabric and is adjacent to said double stitch, and a stitch is formed on said double stitch as said stitch for binding off, and a new stitch is formed on said new stitch, and then, said stitch for binding off and said new stitch are overlapped with each other to form a new double stitch, then a stitch of the first knit fabric opposing to said new stitch is newly transferred to the second needle bed, then, said newly transferred stitch and said new double stitch are overlapped with each other to form a new triple stitch, then a new stitch is formed on a stitch which is among the transferred stitches of the second fabric and is adjacent to said new triple stitch, then, a new stitch for binding off is formed on said new triple stitch, and a new stitch is formed on said new stitch.

The bound off knit fabric of the present invention is characterized by:

a front knit fabric and a back knit fabric having respective final courses comprising a large number of stitches;

said stitches of said final courses have each a sinker loop and a needle loop and a direction from the sinker loop toward the needle loop;

the stitches of the final course of the front knit fabric have a face being at a side opposite to the back knit fabric, and a back being at the same side to the back knit fabric;

the stitches of the final course of the back knit fabric have a face being at a side opposite to the front knit fabric, and a back being at the same side to the front knit fabric; and each of the stitches of the final course of the front knit fabric is overlapped with a stitch of the final course of the back knit fabric, in a manner that the faces of said overlapped stitches abut each other and the directions from the sinker loops toward the needle loops thereof are reverse with each other, to form a large number of overlapped stitches being adjacent in a series, and stitches for binding off formed on respective overlapped stitches are overlapped with adjacent overlapped stitches.

In the present specification, the face/the back of stitches are defined by the conditions before the stitches are overlapped with any other stitches. When one sees a knit fabric from the front, for example, if it is a front body, when one sees the front body from a position opposite to the back body relative to the front body, the aspect one can see is the face, and the aspect one can not see is the back. If it is a back body, when one sees the back body from a position opposite to the front body relative to the back body, the aspect one can see is the face, and the aspect one can not see is the back. In the present specification, the face and the back do not necessarily correspond to the face stitch and the back stitch.

In the embodiments, the first needle bed corresponds to the front bed, and the second needle bed to the rear bed, but this does not necessarily apply to all cases. Furthermore, in the embodiments, the first knit fabric corresponds to the front body, and the second knit fabric to the back body, but this does not necessarily apply to all cases. The direction of a stitch is defined as the direction from the sinker loop at its base toward the needle loop.

For the sake of simplicity, the effects of the present invention will be described with reference to knitting of a cylindrical fabric wherein the front body is knitted on the first needle bed and the back body on the second needle bed. According to the present invention, the stitches of the front body and those of the back body are overlapped with each other in a face/face relationship or in such a way that the faces of two stitches face each other, then binding off is effected. To overlap two stitches in the face/face relationship, it is sufficient to hold the stitches of the back body on the first needle bed, hold the stitches of the front body on the second needle bed, then overlap both the stitches of the front and back bodies with each other.

Transfer of stitches between needle beds, for example, may be used to hold the stitches of the back body on the first needle bed and hold the stitches of the front body on the second needle bed. At first, the face of stitches appears on the side opposite to the trick gap between the needle beds, and the back of stitches appears on the side of the trick gap. When the stitches are transferred, the face of the stitches will appear on the trick gap side; thus the face and the back relationship of the stitches will be reversed. After that, one set of stitches is transferred again to overlap it with the other set of stitches; as a result the two sets of stitches overlap with each other in the face/face relationship. Transfer, in case of a flat knitting machine with two beds, is literally made between the first needle bed and the second needle bed. In case of a flat knitting machine with four beds, for example, with two beds at the front and two beds at the rear, any one bed at the front and any one bed at the rear will do.

Reversal of the face and the back of stitches may be realized by, for example, forming stitches of the back body on the first needle bed. For instance, in a course before binding off, the stitches of the back body are transferred to the first needle bed. Then, on these stitches, new stitches are formed. The new stitches belong to the back body, yet they are formed on the first needle bed and the face of these stitches appears, from the time of knitting, on the trick gap side. By using such stitches, two sets of stitches can be overlapped with each other in the face/face relationship.

For example, two stitches are overlapped with each other in the face/face relationship, then a stitch for binding off is formed on this portion. Then, two stitches of the adjacent wales are overlapped with the stitch for binding off to form a triple stitch. Then this procedure is repeated to bind off. The direction of the stitches for binding off is along the connection line of the two knit fabrics and differs from those of other stitches. The direction of wale of the stitches for binding off is virtually perpendicular to those of other stitches. It, therefore, is desirable that the stitches for binding off do not appear on the top surface of the knit fabric. When the condition after removal from the needles is set as the standard condition, preferably the stitch for binding off is arranged in the middle position or in the innermost (bottom) position among the stitches forming a triple stitch.

In the triple stitch, at first the direction of the stitch of the front body and that of the stitch of the back body are identical. When the triple stitch is removed from the needle, however, one stitch will make virtually one half turn since two stitches are overlapped with each other in the face/face relationship. This one half turn is due to the nature of the triple stitch itself and occurs spontaneously. The cause of the half turn is the overlapping of the front and back bodies in the face/face relationship. As a result, the bound off portion will become flat, thus the front body and the back body are connected flat. The turn occurs in the knit fabric on which no stitches for binding off were formed. For example, if the stitches for binding off are knitted on the back body, the stitches of the front body will turn. The turn is accompanied by a twist in the stitch, and in principle, the twist occurs on the stitch that turned. Hence, preferably, before forming overlapped stitches, stitches are knitted with twist in advance; the twist given in advance will cancel the twist resulting from the turn after the formation of the triple stitch. In this way, the knit fabric can be completed without any twist on their stitches.

Preferably, whenever a triple stitch is formed, at least one stitch is newly formed on a stitch adjacent to the triple stitch in the second knit fabric. Then the prolongations of this stitch will pull the second knit fabric towards the triple stitch, and the new stitch will be concealed under the stitch of the first knit fabric. This also serves to make the bound off portion less conspicuous.

The stitch of the first knit fabric and the stitch of the second knit fabric are overlapped with each other, and a stitch for binding off is formed on them to form a triple stitch. In the process, if the stitch of the first knit fabric is knitted without giving a twist in advance, the stitch of the first knit fabric will turn when the triple stitch is removed from the needle. Thus the prolongations thereof will cross each other. A force will be exerted to one of the prolongations by the stitch for binding off, and the prolongation will cone up from the knit fabric. This prolongation, however, is on the lower side of the cross, and can not come up from the knit fabric because it is kept suppressed by the other prolongation.

DETAILED DESCRIPTION OF THE PREFERRED EMBODIMENTS

With reference to the attached drawings, embodiments of the binding method according to the present invention will be described in detail. A flat knitting machine to be used must be one which is provided at least a first needle bed and a second needle bed each having a large number of needles, said needle beds are slidable relative to each other in the longitudinal direction, and in which stitches can be transferred between said needle beds. The flat knitting machine is not limited to the machine with two beds used in the embodiments. A flat knitting machine with four beds will do. What contributes to the reversal of the face and the back of a knit fabric is a transfer between the front bed and the rear bed. Hence the transfer between the front bed and the rear bed according to the embodiments means, in the case of a flat knitting machine with four beds, a transfer between a front bed and a rear bed.

Figure 1:
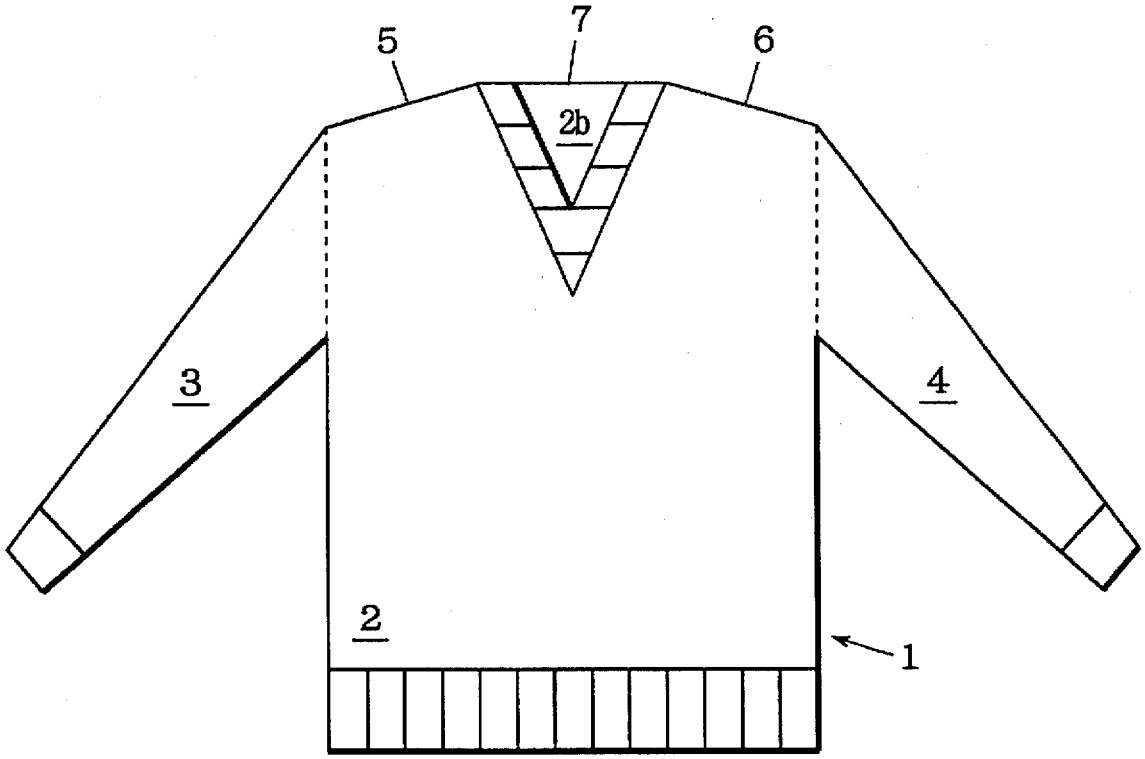
FIG. 1 is a diagram showing a pullover 1 of which binding off is completed in the embodiments.
Figure 2:
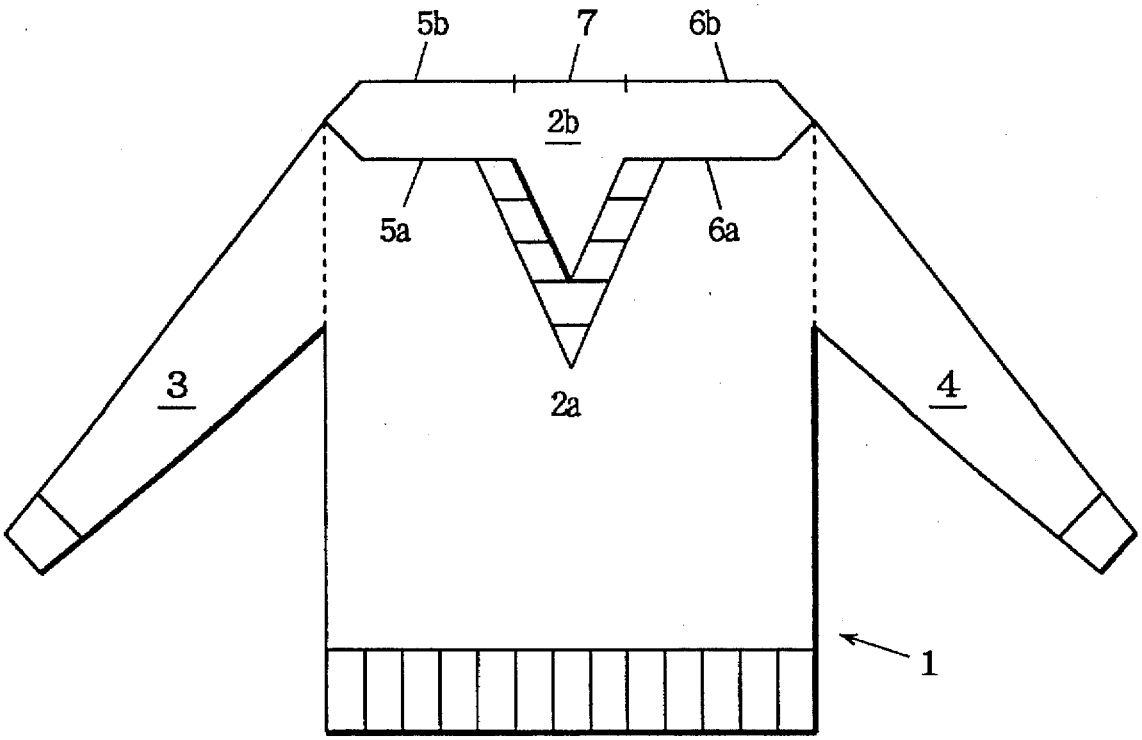
FIG. 2 is a diagram showing the pullover 1 before the start of binding off in the embodiments.

FIG. 1 shows the state of a pullover 1 to be knitted according to the present invention at the time of its completion. The pullover 1 comprises a front body 2*a*, a back body 2*b*, a right sleeve 3 and a left sleeve 4. The front body 2*a* and the back body 2*b* are to be knitted together into one cylindrical form. The sleeves 3, 4 are to be knitted into separate cylinders. Needles of different areas of the needle beds are allocated to these portions respectively. The bodies 2*a*, 2*b* and the sleeves 3, 4 are knitted separately up to the armholes, then they are joined together to the condition shown in FIG. 2 by the method disclosed in the Japanese Provisional Patent Publication No. HEI4-41752 (U.S. Pat. No. 5,203,185, EP 460,915B). For the knitting up to this stage, one yarn feeder may be used to feed the same yarn to both the needles of the front bed and the needles of the rear bed, and in case of knitting a vest, etc., different yarn feeders may be used for the front body 2*a* and the back body, respectively. Starting from the condition of FIG. 2, at both the right shoulder 5 and the left shoulder 6, the stitches of the final courses are overlapped with each other and binding off is effected to bring the garment into its completed condition shown in FIG. 1. In the following, using the binding off at the left shoulder 6 as an example, the embodiment 1 through the embodiment 3 will be explained. The binding off at the right shoulder 5 is identical to that at the left shoulder 6. In the embodiments, a machine with two beds, i.e. a pair of one front bed and one rear bed, is used. In the knitting course diagrams, the capital letters of alphabet indicate the needles of the front needle bed, and the small letters indicate those of the rear bed. For the convenience of explanation, a smaller number of needles than those actually used are indicated in the description.

First Embodiment

Figure 3:
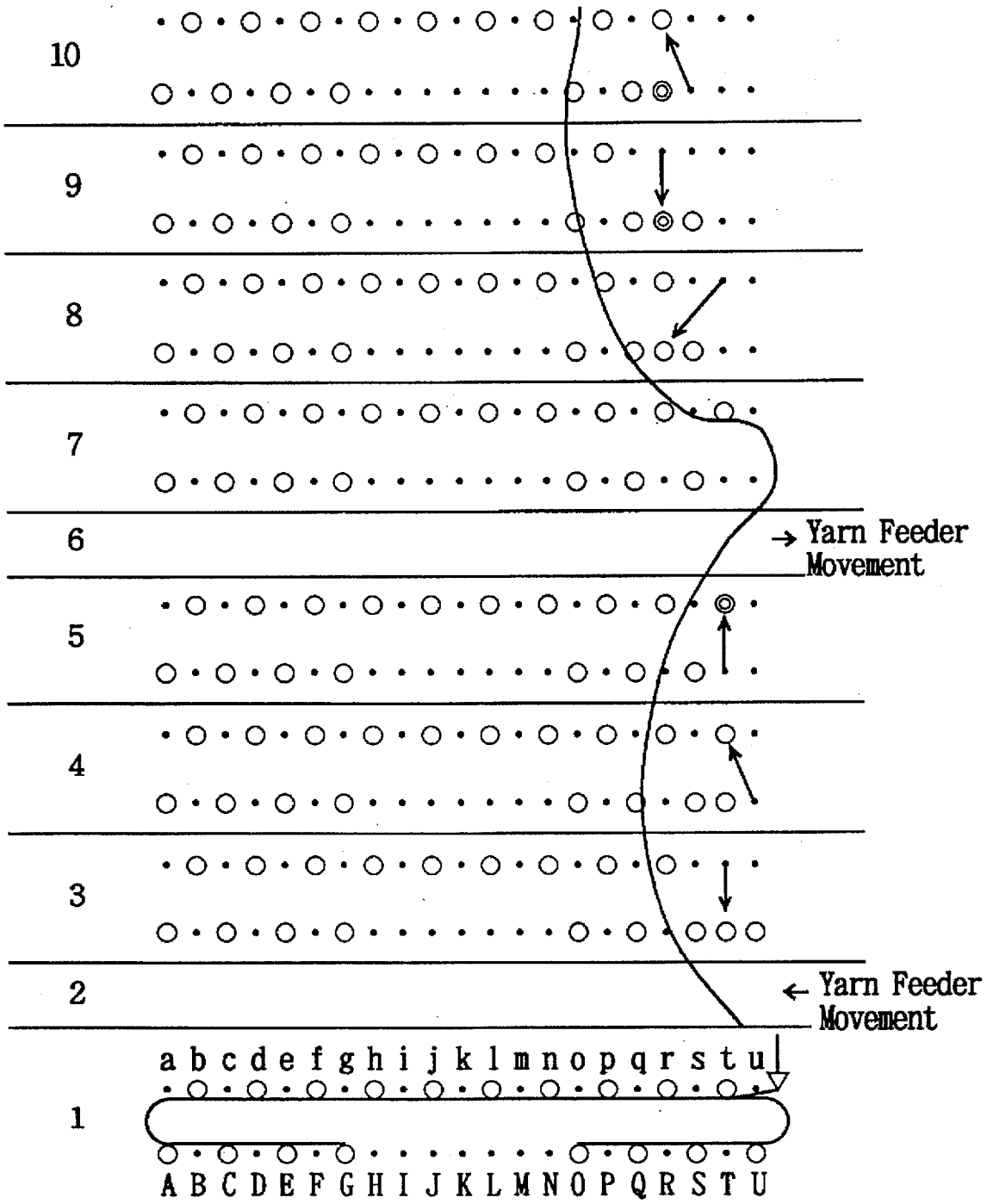
FIG. 3 is a knitting course diagram illustrating the first embodiment.
Figure 4:
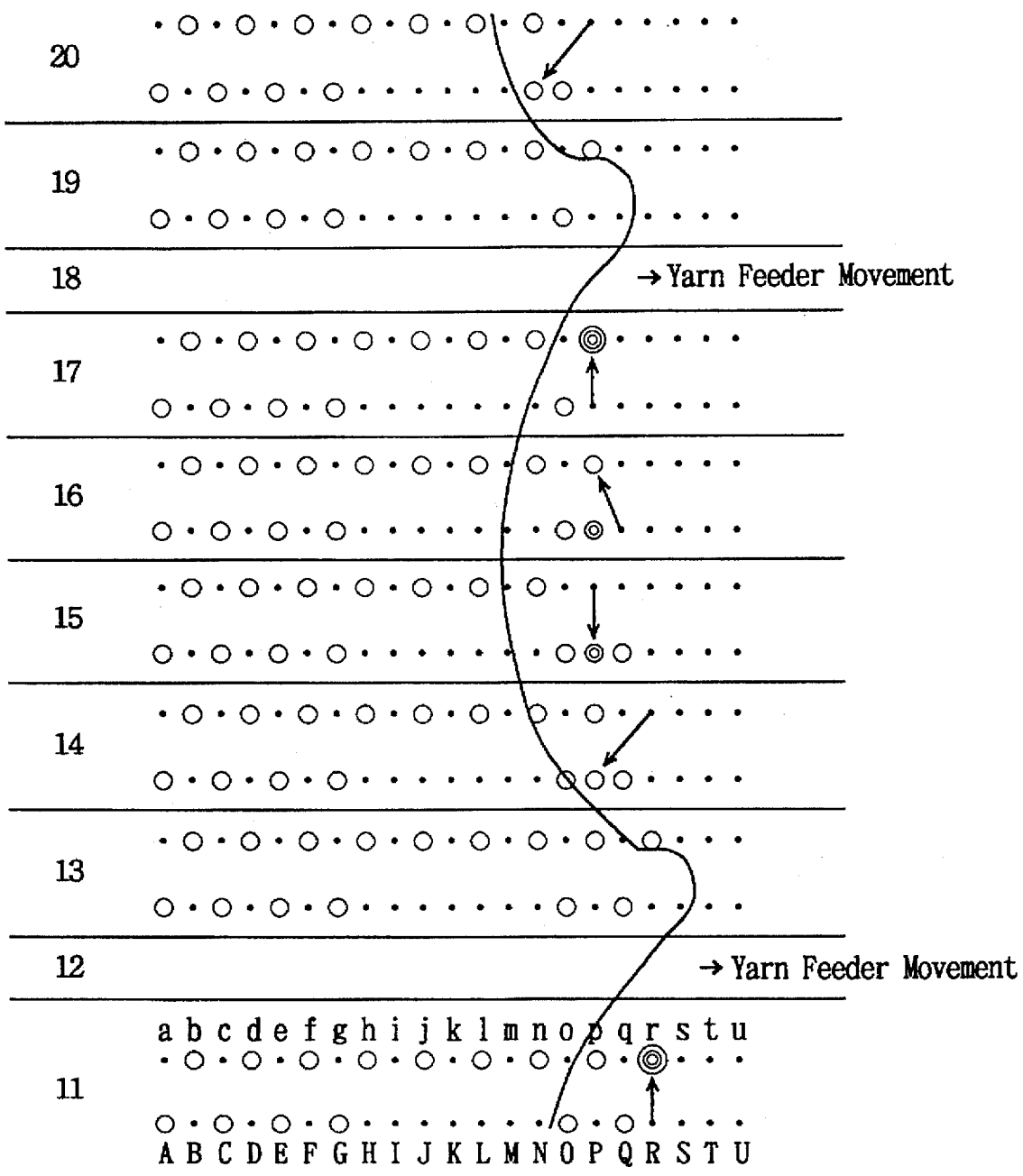
FIG. 4 is a knitting course diagram illustrating the first embodiment.
Figure 5:
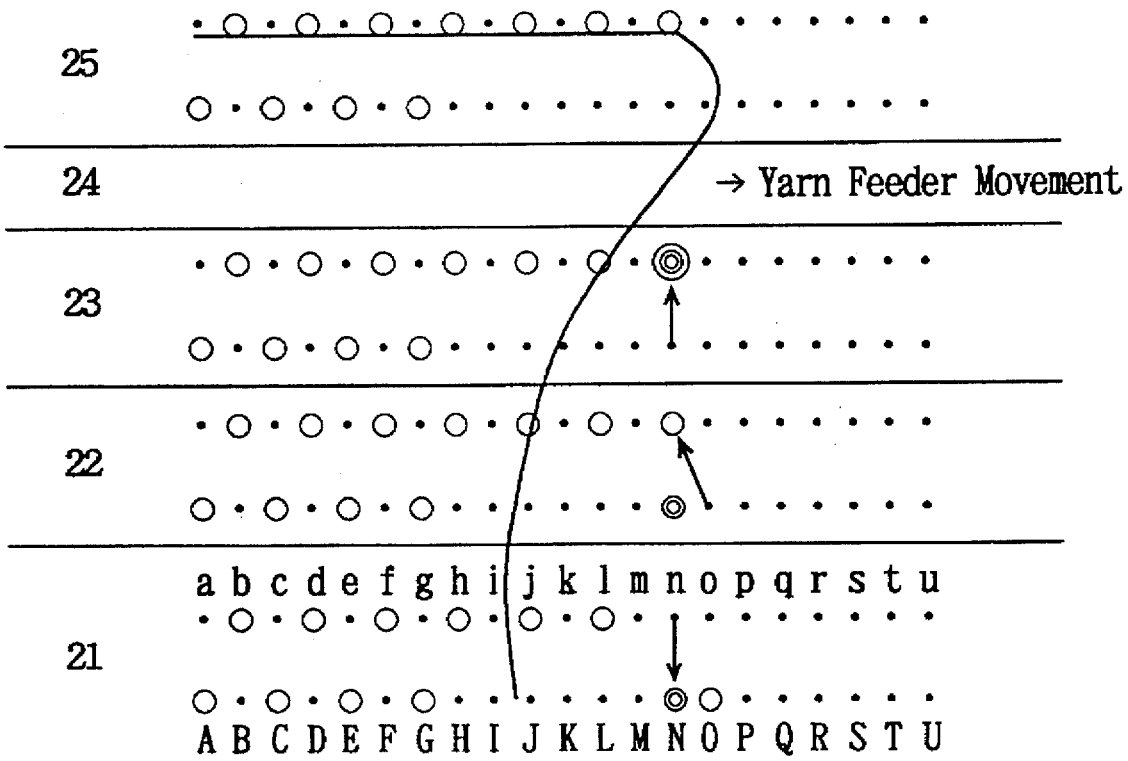
FIG. 5 is a knitting course diagram illustrating the first embodiment.

The first embodiment of the present invention will be explained with reference to the knitting course diagrams of FIG. 3 through FIG. 5 and FIG. 6 which illustrates the knitted structure of the bound off portion at the time of completion of binding off. The course 1 of FIG. 3 shows the completion of stitches formed by moving a yarn feeder from the needle G of the front bed to the left as seen in FIG. 3 to feed the yarn to and from stitches on the needles G, E, C, A of the front bed, then moving the yarn feeder to the right to feed the yarn to and form stitches on the needles b, d, . . . , r, t of the rear bed. Binding off is effected in the courses subsequent to the course 1, and the stitches shown in the course 1 will become the stitches of the final courses of the present embodiment. The pullover 1 is knitted in such a way that in each course of FIG. 3 the lower portion indicates the front and the upper portion indicates the back. Accordingly, in the course 1, the stitches held on the alternate needles A, C, E and G of the front bed belong to the right front shoulder 5*a*, and the stitches held on the needles b, d, f and h of the rear bed belong to the right back shoulder 5*b*. The stitches of the back collar 7 are held on the needles j and l of the rear bed, the stitches of the left back shoulder 6*b* are held on the needles n, p, r and t of the rear bed, and the stitches of the left front shoulder 6*a* are held on the needles U, S, Q and O of the front bed, respectively.

In this embodiment, because a flat knitting machine with a pair of a front bed and a rear bed is used, stitches held on the front bed are shifted in phase by one needle relative to stitches held on the rear bed, and empty needles on which no stitches are held are provided between the stitches and used for transfer. Thus even when two knit fabrics are overlapped with each other, one in the front and one in the rear, transfer is still possible. In the following, starting from the condition shown in FIG. 2, the front shoulders and the back shoulders are connected at the left and right shoulders, respectively, to the condition shown in FIG. 1. The knitting at the right shoulder 5 and that at the left shoulder 6 are identical symmetrically. Hence the explanation is limited to the connection and binding off of the left front shoulder 6*a* and the left back shoulder 6*b*.

First, in the course 1 of FIG. 3, the yarn feeder is located on the right of the needle t of the rear bed on which the last stitch of the knitting prior to the course 1 not illustrated was made. The stitch located at one end of the left front shoulder 6*a* is held on the needle U of the front bed, and the stitch at the end of the left back shoulder 6*b* is held on the needle t of the rear bed. In the present embodiment, binding off is made in the direction from the outer side towards the inner side of the left shoulder 6 (from the needle U towards the needle O on the front bed, and from the needle t towards the needle n on the rear bed). In the course 2, the yarn feeder is shifted to the left from the condition shown in the course 1. In the course 3, the stitch of the left back shoulder 6*b* held on the needle t of the rear bed is transferred onto the needle T of the front bed. In the next course 4, the stitch 12 of the left front shoulder 6*a* held on the needle U of the front bed is transferred onto the needle t of the rear bed. Next, in the course 5, the stitch 11 of the left back shoulder 6*b*, which has been transferred onto the needle T of the front bed by the course 3, is transferred onto the needle t of the rear bed to overlap the stitch 12 of the left front shoulder 6*a* and the stitch 11 of the left back shoulder 6*b* with each other. Next, in the course 6, the yarn feeder is shifted to the right. Then in the course 7, while the yarn feeder is shifted to the left, the yarn is fed to the needle t of the rear bed to form the stitch 13 of the next course. As a result, the stitch 12 of the left front shoulder 6*a* which was held on the needle U of the front bed in the course 1 is overlapped with the stitch 11 of the left back shoulder 6*b* which was held on the needle t of the rear bed, and these stitches are held by the stitch 13 which was formed on the needle 8 of the rear bed in the course 7.

Next, in the course 8, the stitch 12 held on the needle t of the rear bed is transferred onto the needle R of the front bed. Then, in the course 9, the stitch 14 of the left back shoulder 6b held on the needle r of the rear bed is transferred onto the needle R of the front bed to overlap the stitch 13, which was newly formed on the needle t of the rear bed in the course 7, and the stitch 14 of the left back shoulder 6b with each other. In the next course 10, the stitch 15 of the left front shoulder 6a held on the needle S of the front bed is transferred onto the needle r of the rear bed. Then in the course 11 of FIG. 4, the two stitches held on the needle R of the front bed are transferred onto the needle r of the rear bed to hold on the needle r three stitches; the stitch 15 of the left front shoulder 6a, the stitch 14 of the left back shoulder 6b, and the stitch which was formed on the needle t of the rear bed in the course 7. Then, in the course 12, the yarn feeder is shifted to the right. In the course 13, while the yarn feeder is shifted to the left, the yarn is fed to the needle r of the rear bed to form a stitch. As a result, the three overlapped stitches are held by the stitch 16 which was newly formed on the needle r of the rear bed.

Subsequently, in the course 14 through the course 24, knitting similar to that made in the course 8 through the course 13 is repeated towards the inner side of the left shoulder 6 (to the left as seen in the diagrams) for the required number of times according to the number of stitches of the shoulder of the pullover 1. Then in the course 25, the yarn is fed to the needle n of the rear bed, on which three stitches are overlapped with each other, to form a new stitch, and the yarn is also fed to the needles l, j, . . . , d, b of the rear bed to knit one course of the back collar 7 and one course of the right back shoulder 5a. In this way, the binding off of the left shoulder 6 of the pullover 1 is completed. Subsequently, a binding off similar to that of the left shoulder 6 is given to the right shoulder 5. Next, binding off is given by the well-known method to the back collar 7 to complete the knitting of the pullover 1.

Figure 6:
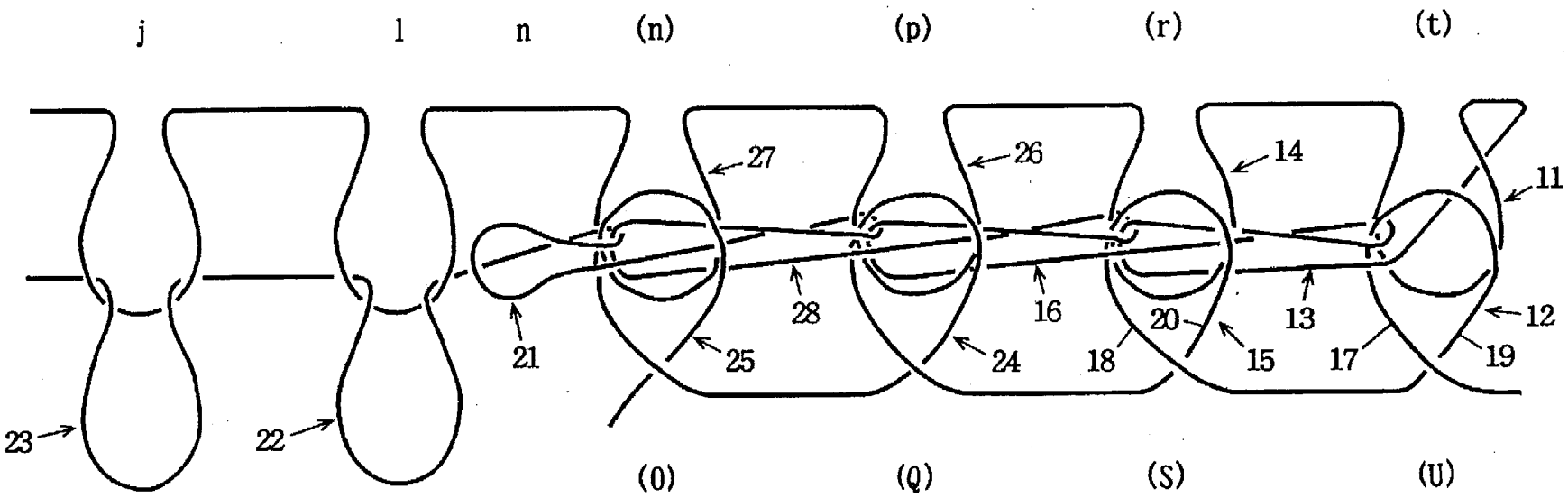
FIG. 6 is a knitted structure diagram illustrating a bound off portion of the pullover 1 bound off according to the first embodiment.

The knitted structure of the bound off portion at the time of completion of the knitting up to the course 25 of the first embodiment is shown in FIG. 6. In FIG. 6, alphabets indicating the needle numbers show the needles used in knitting stitches. Alphabets in parentheses indicate that stitches have been removed from the needles. Alphabets without parentheses indicate that stitches are held on the needles at the time of completion of the knitting of the course 25. The stitch 21 newly formed on the needle n of the rear bed in the course 25 is held on the needle of the rear bed together with other stitches 22, 23 formed on the needles l, j, . . . , of the rear bed in the course 24. However, to represent the relationship of stitches for easier comprehension, the stitch 21 alone is shown irregularly.

According to the conventional binding off method, the stitches of the left front shoulder 6a are arranged at the front, and the stitches of the left back shoulder 6b are arranged at the rear, then these stitches are overlapped with each other. Thus the backs of the stitches face each other. When a slash mark / is used to represent the interface between two stitches, they are expressed by back/back. In contrast to it, according to the present invention, the stitches are overlapped in such a way that the stitches 12, 15, 24 and 25 of the left front shoulder 6a are arranged at the rear and the stitches 11, 14, 26 and 27 of the left back shoulder 6b are arranged at the front. Hence the contact between the stitches at the overlapping interface is face/face. It should be noted that in the embodiments the aspect of the knit fabric that appears on the exterior when the knit fabric is seen from the front before overlapping is defined as the face of the stitches, and the aspect that is concealed in the cylindrical knit fabric is defined as the back of the stitches. Next, stitches 13, 16, 21 and 28 of the next course are formed on the needles on which the stitches 12, 15, 24 and 25 of the left front shoulder 6a and the stitches 11, 14, 26 and 27 of the left back shoulder 6b are held in the overlapped condition. These stitches 13, 16, 21 and 28 are unique stitches for binding off, and in the embodiments they may be referred to as stitches that extend to adjacent wales. If we assume these stitches are those of the back body 6b, the contact relationship of the triple stitches is back (stitch 26) face/back (stitch 16) face/face (stitch 24) back.

The stitches 12, 15, 24 and 25 of the left front shoulder 6a will make one half turn clockwise when they are removed from the needles. This is because the stitches 14, etc. and the stitches 15, etc. are overlapped with each other in the relationship of face/face. When they are removed from the needles, the stitches 15, etc. of the front body, which tend to turn easily, will make one half turn. The axis of this rotation is perpendicular to the plane in which the triple stitch is present, and the turn will not reverse the face and the back of the stitches 15, etc. As a result of this turn, the direction of the stitches 11, 14, 26 and 27 of the left back shoulder 6b become opposite to that of the stitches 12, 15, 24 and 25 of the left front shoulder 6a; the direction of a stitch is defined as the direction from sinker loop to needle loop. In the present specification, when the directions of two stitches are opposite to each other, it may be referred to as "two stitches face each other." When the stitches 15, etc. of the front body make one half turn, protrusion of the bound off portion between the front body and the back body will be suppressed.

The stitches 13, 16 and 28, which are overlapped with the stitches of adjacent wales after the stitches 11, 14, 26 and 27 of the left back shoulder 6b and the stitches 12, 15, 24 and 25 of the left front shoulder 6a are formed in an overlapped condition, will be concealed under the stitches 12, 15, 24 and 25 of the left front shoulder 6a and the stitches 11, 14, 26 and 27 of the left back shoulder 6b. This is because the stitches 13, 16 and 28 are overlapped in such a way that they are placed between stitches 14, etc. and 15, etc. As a result, the stitches 13, 16 and 28, which extend over adjacent wales, do not appear on the top surface of the knit fabric. When we pay attention to the stitch 16, in the course 17 of FIG. 4, it is held on the needle p of the rear bed in the relation of (stitch 15 bottom) face/face (stitch 16 middle) back/face (stitch 14 top). Top, middle and bottom indicate the overlapping positions on the needle p. When this triple stitch is removed from the needle p, as mentioned above, the stitch 15 will turn by 180 degrees, and at the same time the stitch 15 will take the top position, the stitch 16 the middle position, and the stitch 14 the bottom position. This is because the triple stitch is formed on the rear bed, and in this case, the top and bottom positions of the triple stitch on the needle p and those of the triple stitch off the needle are reverse to each other. In the course 17 of FIG. 4, if the stitch of the front body is transferred from the needle p of the rear bed onto the needle P of the front bed to make a triple stitch, the result when the triple stitch is removed from the needle would not change, like that of FIG. 6, the order would be stitch 14 (bottom)/stitch 16 (middle)/stitch 15 (top).

The stitches 12, 15, 24 and 25 of the left front shoulder 6a, which come to the top surface of the knit fabric when the relevant stitches are overlapped with each other, are suppressed by the stitches 13, 16 and 28 which extend to the adjacent wales. As a result, of the yarn forming the stitches, the portions on the left, 17 and 18 are suppressed downward, and the portions on the right 19 and 20 tend to come up. When the binding off is completed, the stitches 12, 15, 24 and 25 of the left front shoulder 6*a* are twisted, and the prolongations on the left 17, 18 of the stitches 12, 15, 24 and 25 will take upper positions, and the prolongations on the right 19 and 20 will take lower positions; the prolongations 20 and 20 tend to come up but they will be suppressed by the prolongations 17 and 18. As a result, the stitches of the completed knit fabric will not tilt, and there will be no yarns coming up to make the bound off portion irregular; smooth and flat binding off can be achieved.

Second Embodiment

Figure 7:
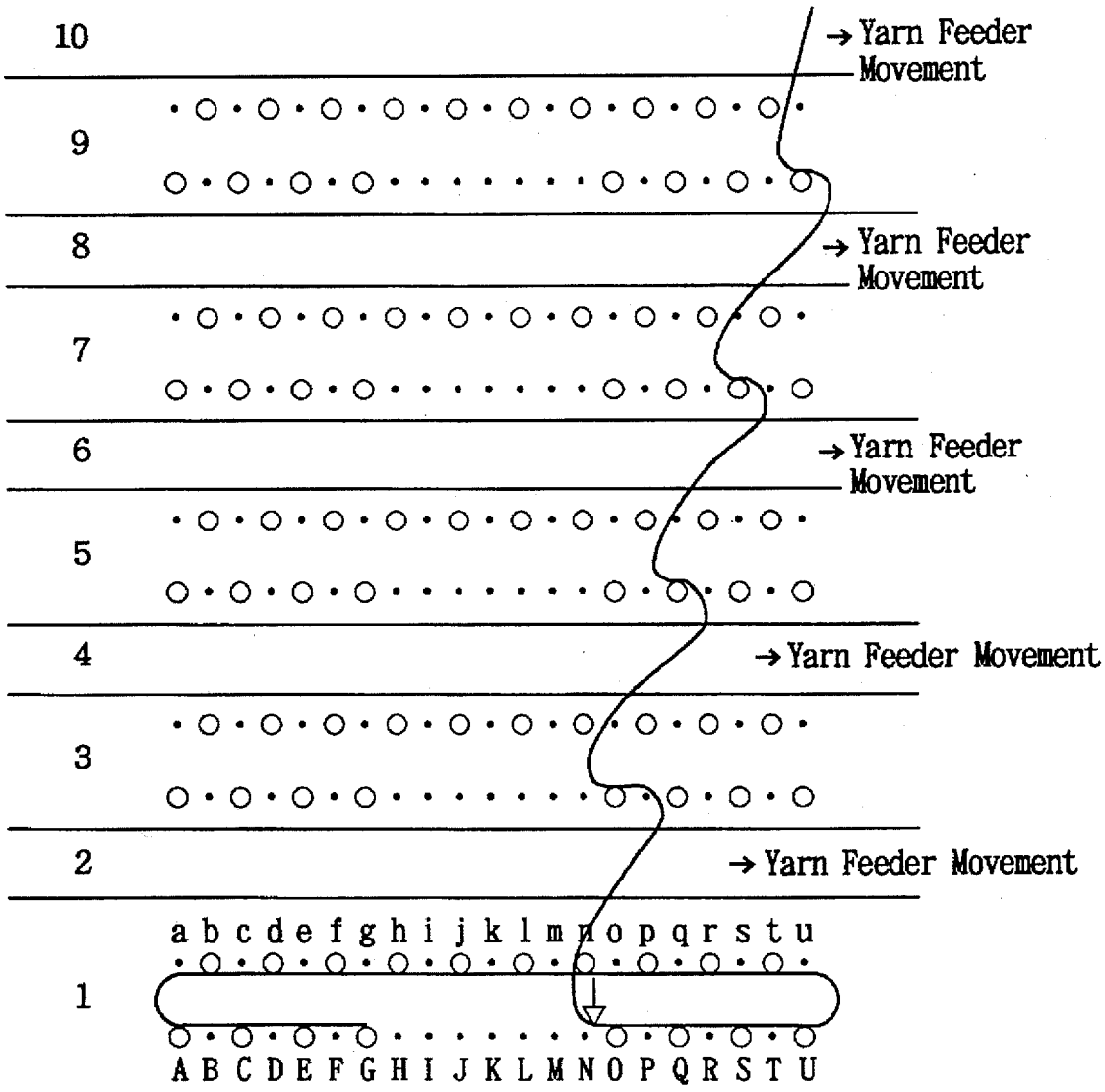
FIG. 7 is a knitting course diagram illustrating the second embodiment.
Figure 8:
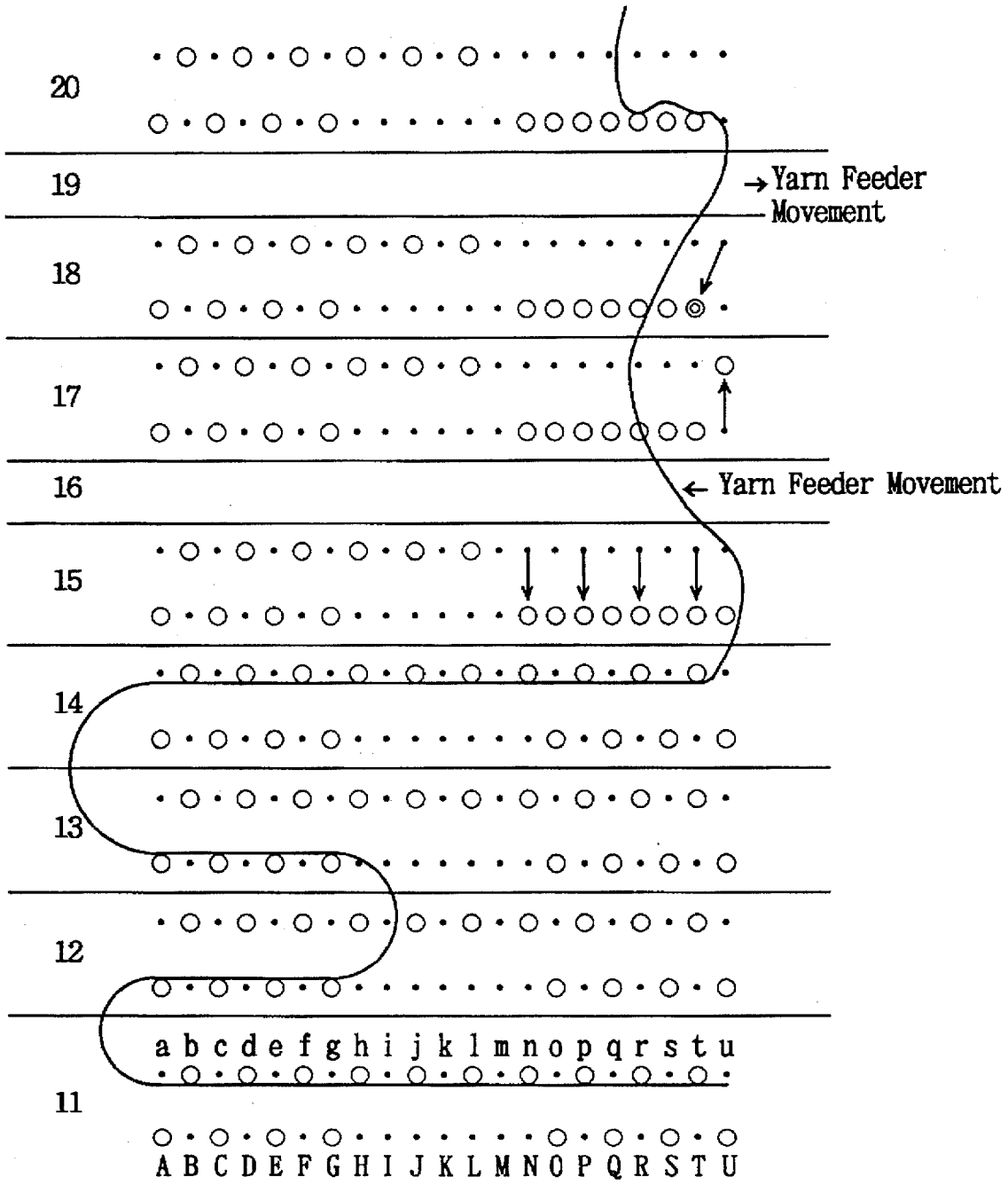
FIG. 8 is a knitting course diagram illustrating the second embodiment.

Next, the second embodiment of the present invention will be described with reference to the knitting course diagrams of FIG. 7 through FIG. 10, and FIG. 11 which illustrates the knit structure of the bound off portion. The course 1 of FIG. 7 illustrates the condition just when the formation of stitches is completed by shifting the yarn feeder to the left from the condition shown in the course 1 of FIG. 3 of the first embodiment to feed the yarn to the needles U, S, Q and O of the front bed sequentially. At this time, the yarn feeder is located on the left of the needle O of the front bed on which the last stitch was formed.

In the second embodiment, preparatory courses for binding off are made in the course 2 through the course 14. In the course 2 of FIG. 7, the yarn feeder is shifted to the right, then in the course 3, while the yarn feeder is shifted to the left, the yarn is fed to the needle O of the front bed to form a stitch. Next, of the subsequent courses 4 through 9, in the even number courses 4, 6 and 8, the yarn feeder is shifted to the right, and in the odd number courses 5, 7 and 9, while the yarn feeder is shifted to the left, the stitches are formed. In this way, stitches are sequentially formed on the needles Q, S and U of the left front shoulder 6. In the course 10 following the course 9, while the yarn feeder is shifted to the left, the yarn is fed to alternate needles t, r . . . , d, b of the rear bed to form stitches of the next course. Next, in the course 12 and the course 13, the yarn is fed to the needles A, C, E and G of the front bed to form stitches of the front right shoulder 5*a*. Next, in the course 14, the yarn is fed to alternate needles b, d . . . r, t of the rear bed to knit the right back shoulder 5*b*, the back collar 7 and the left back shoulder 6*b*.

In the knitting shown in the course 1 through the course 14, if the stitches on the needles O, Q, S and U of the front bed, which are to be twisted by the subsequent knitting, are knitted in a pretwisted condition in the opposite direction, the twists at the time of completion would be eliminated. The state of completion of the course 14 of the second embodiment corresponds to the course 1 of the first embodiment. Hence, if twists of stitches do not pose any problem, as shown in the course 1 of the first embodiment, binding off might be started when the stitch is formed on the needle t of the rear bed, which stitch constitutes the outermost stitch of the left back shoulder.

Next, in the course 15, stitches of the left back shoulder 6*b* held on the needles n, p, r and t of the rear bed are transferred onto the needles N, P, R and T of the opposite front bed. In the present embodiment, from the viewpoint of knitting efficiency, the stitches of the back body being held on the needles n, p, r and t of the rear bed are transferred collectively in the course 15 onto the needles of the front bed. They, however, may be transferred sequentially according to the progress of the binding off. It should be noted that either the stitches of the front body or the stitches of the back body should not be transferred collectively. For example, in the case of the embodiment, the stitches of the front body are transferred one by one. Next, in the course 16, the yarn feeder is shifted to the left, then in the course 17, the stitch 31 of the left front shoulder 6*a* held on the needle U of the front bed is transferred onto the needle u of the rear bed. In the course 18, the stitch 31 is transferred onto the needle T of the front bed to overlap it with the stitch 32 of the left back shoulder 6*b*; the two stitches are overlapped with each other on the needle T of the front bed. Next, in the course 19, the yarn feeder is shifted to the right, then in the course 20, the yarn is fed to the needles T and R of the front bed to form the stitches 33, 34 of the next course. As a result, the stitch 31 of the left front shoulder 6*a* which was held on the needle U of the front bed in the course 1 and the stitch 32 of the left back shoulder 6*b* held on the needle t of the rear bed are overlapped with each other, and they are held by the stitch 33 newly formed on the needle T of the front bed in the course 20. As the stitches 33, 34, etc. are formed on the stitches of the back body, they are stitches of the back body. Although they are stitches of the back body, they are formed on the front bed, hence the face of these stitches appear on the trick gap side.

Figure 9:
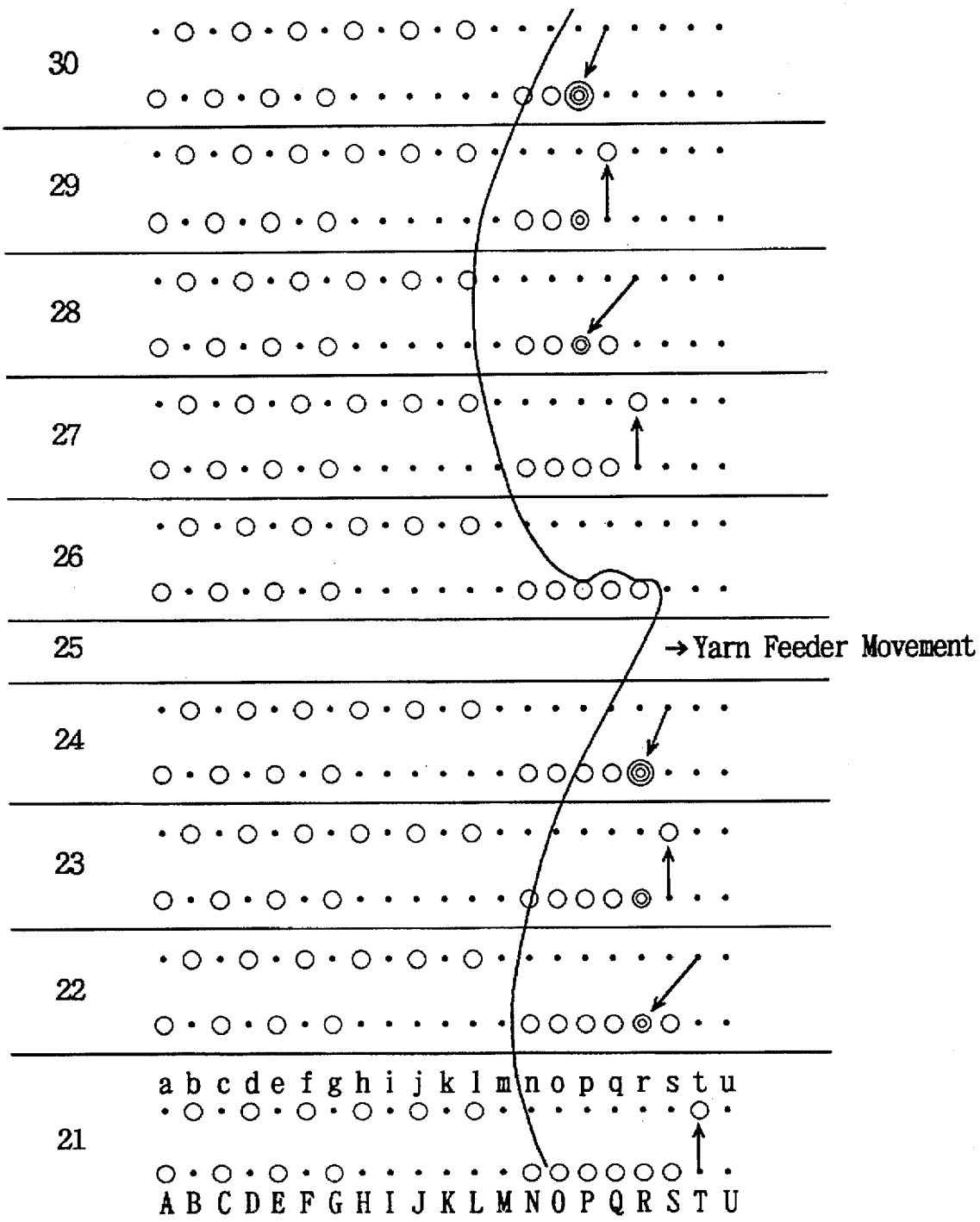
FIG. 9 is a knitting course diagram illustrating the second embodiment.
Figure 10:
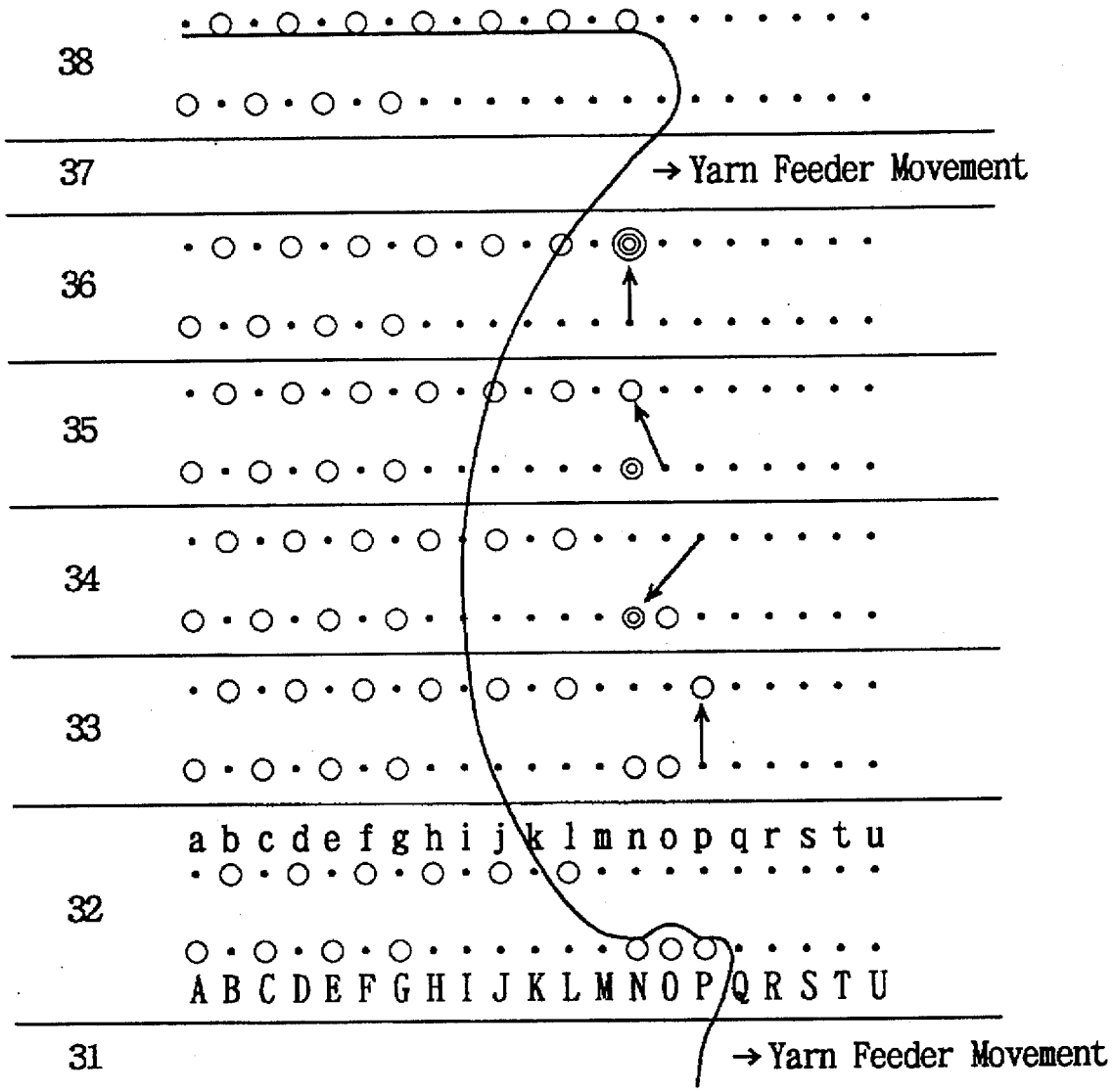
FIG. 10 is a knitting course diagram illustrating the second embodiment.

Next, in the course 21 of FIG. 9, the stitch 33 held on the needle T of the front bed is transferred onto the needle t of the rear bed, and in the course 22, the stitch 33 is further transferred onto the needle R of the front bed to overlap it with the stitch 34 of the left back shoulder held on the needle R. Next, in the course 23, the stitch 35 of the left front shoulder 6*a* held on the needle S of the front bed is transferred onto the needle s of the rear bed, and in the course 24, the stitch 35 is further transferred onto the needle R of the front bed. As a result, three stitches are overlapped with each other on the needle R of the front bed, in the order of the stitch 34 (bottom) of the left back shoulder 6*b*, the stitch 33 (middle) newly formed on the needle t in the course 20, and the stitch 35 of the left front shoulder 6*a* (top).

Figure 11:
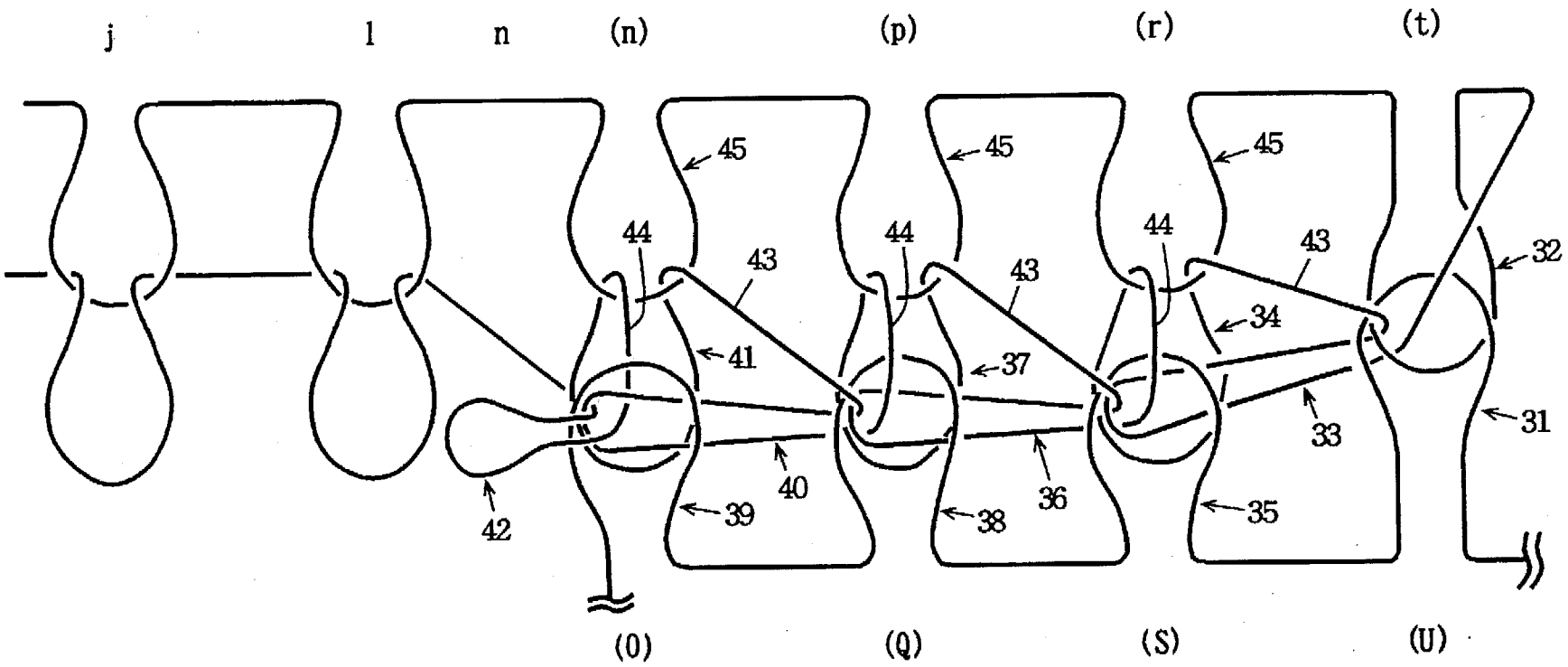
FIG. 11 is a knitted structure diagram illustrating a bound off portion of the pullover 1 bound off according to the second embodiment.

In the first embodiment, as shown in FIG. 6, the stitch 11 and the stitch 14 of the left back shoulder 6*b* to be connected with the stitches of the left front shoulder 6*a* are stitches that were formed in the same course. In the second embodiment, however, as shown in FIG. 11, in the course 20, the yarn is also fed to the needle R of the front bed, on which the stitch of the left back shoulder 6*b* is held, to form the stitch 34 of the next course. Hence the stitch which is held on the needle R of the front bed in the course 21 is not the stitch which was held on the needle r of the rear bed in the course 14 but the stitch 34 which was newly formed on the needle R of the front bed in the course 20. According to the present embodiment, in the course 20, the yarn is fed to the needle T, which holds the stitch 31 of the left front shoulder 6*a* and the stitch 32 of the left back shoulder 6*b* overlapped with each other, and the yarn is also fed to an adjacent needle R to form stitches. Because of this arrangement, the stitch 32 of the left back shoulder 6*b*, which is overlapped with the stitch 31 of the left front shoulder 6*a* at first, and the stitch 34 of the left back shoulder 6*b*, which is overlapped with the stitch 35 of the left front shoulder 6*a* in the course 24, are formed in different courses, respectively. The stitch 34 is one which was formed in the course next to that of the stitch 32. In the present embodiment, stitches which are overlapped with the stitches of the left front shoulder 6*a*, including stitches formed in the course of binding off, are regarded as stitches of the final course of the left back shoulder 6*b*.

Next, in the course 25, the yarn feeder is shifted to the right, and in the course 26, the yarn is fed to the needles R and P of the front bed to form stitches 36 and 37. With this step, the three stitches held on the needle R of the front bed in the course 24 are removed from the needle R while the three stitches are held by the stitch 36 newly formed on the needle R. In the subsequent course 27 through the course 32, knitting similar to that indicated in the course 21 through the course 26 is made towards the inner side of the left shoulder 6 (needle U→needle O, needle t→needle n). When the knitting shown in the course 21 through the course 26 is repeated, the left front shoulder **6*a* and the left back shoulder 6*b* are connected together. In the course 32 of FIG. 10, the yarn is fed to the needle P of the front bed, on which the stitch 38 of the left front shoulder 6*a* and the stitches 36, 37 of the left back shoulder 6*b* are held in overlapped condition, and to the needle N of the same bed. It results in that only the stitch 39 of the left front shoulder 6*a* is held on the needle O of the front bed, said needle O being the innermost needle for the left front shoulder 6*a***.

In the course 33, the stitch 40 formed on the needle P of the front bed in the course 33 is transferred onto the needle p of the rear bed. Then this stitch is further transferred onto the needle N of the front bed to overlap it with the stitch 41 of the left back shoulder **6*b*. Next, in the course 35, the stitch 39 held on the needle O of the front bed, which is the innermost stitch of the left front shoulder 6*a*, is transferred onto the needle n of the rear bed. In the course 36, the stitch 41 of the left back shoulder 6*b* and the stitch 40 formed in the course 32, both stitches being held on the needle N of the front bed, are transferred onto the needle n of the rear bed. As a result, three stitches are held on the needle n of the rear bed. In the course 37, the yarn feeder is shifted to the right, then in the course 38, the yarn feeder is fed to the needle N of the rear bed to form the stitch 42, and at the same time, the yarn is fed to the needles L, J . . . of the rear bed to form stitches. In this way, the binding off of the left shoulder 6 is completed. After that, in a similar manner, knitting similar to that described above is given to the right shoulder 5, and well-known binding off is given to the back collar 7 between the right shoulder 5 and the left shoulder 6 to complete knitting of the pullover 1**.

The knitted structure of the bound off portion upon the completion of knitting up to the course 38 (inclusive) of the above-mentioned processes is shown in FIG. 11. The stitches 31, 35, 38 and 39 of the right front shoulder **6*a* and the stitches 32, 34, 37 and 41 of the left rear shoulder 6*b* have been joined together, and they have been bound off and removed off the needles. The pullover 1 knitted according to the second embodiment has, just like the first embodiment, the stitches 31, 35, 38 and 39 of the left front shoulder 6*a* at the rear, and the stitches 32, 34, 37 and 41 of the left back shoulder 6*b* at the front; two sets of stitches are overlapped with each other, with their faces facing to each other. Accordingly, when the stitches 33, 36, 40 and 42 of the next course are formed on the needles holding the stitches 31, 35, 38 and 39 of the left front shoulder 6*a* and the stitches 32, 34, 37 and 41 of the left back shoulder 6*b* in the overlapped condition and then the stitches are removed from the needles, the stitches 31, 35, 38 and 39 of the left front shoulder 6*a* will make one half turn clockwise. As a result, as shown in FIG. 11, the stitches 32, 34, 37 and 41 of the left back shoulder 6*b* and the stitches 31, 35, 38 and 39 of the left front shoulder 6*a* are overlapped with each other, both sets facing each other and one set coming beneath the other. The stitch relationship of the triple stitches is back (stitch 45) face/back (stitch 34) face/back (stitch 33) face/face (stitch 35**) back.

The prolongations 43 and 44 extending from the left back shoulder **6*b* which is overlapped with the left front shoulder 6*a* pull the stitch 45 formed on the left back shoulder 6*b* in the course 14 towards the left front shoulder. As a result, the stitches 34, 37 and 41 of the left back shoulder 6*b*, which are overlapped with the stitches of the left front shoulder 6*a*, will be concealed under the stitches 35, 38 and 39 of the left front shoulder 6*a*; on the top surface of the knit fabric, the stitches 45 formed on the left back shoulder 6*b* in the course 14 and the stitches 35, 38 and 39 of the left front shoulder 6*a* will appear to be continuous to each other. Accordingly, the fabric knitted according to the present embodiment is bound off flat in such a way that the bound off portion does not protrude from the knit fabric. The stitches 33, 36 and 40 extending to adjacent wales are concealed under the stitches 35, 38 and 39 of the left front shoulder 6*a*, and the stitches 33, 36 and 40** extending to adjacent wales never appear on the top surface of the knit fabric.

Third Embodiment

In the following, the third embodiment of the present invention will be described. The third embodiment differs from the second embodiment in the binding off method, but both embodiments have one characteristic in common that the stitches of the left front shoulder **6*a* and the stitches of the left back shoulder 6*b* are overlapped with each other, one overlapping on the front side of the other, and then binding off is effected (accompanied by a range of modifications that can be easily altered, such as changes of needles on which stitches are to be made, and changes of the sequence of forming stitches). In the following, with reference to the knitting course diagrams of FIGS. 12 through 14 and FIG. 15 illustrating the bound off portion, the third embodiment will be described. According to the third embodiment, before starting binding off, are made the preparatory processes for binding off as shown in the course 1 through the course 14 of the second embodiment. The explanation starts with the course 1 which coincides with the time of completion of the knitting up to the course 14** of the second embodiment.

Figure 12:
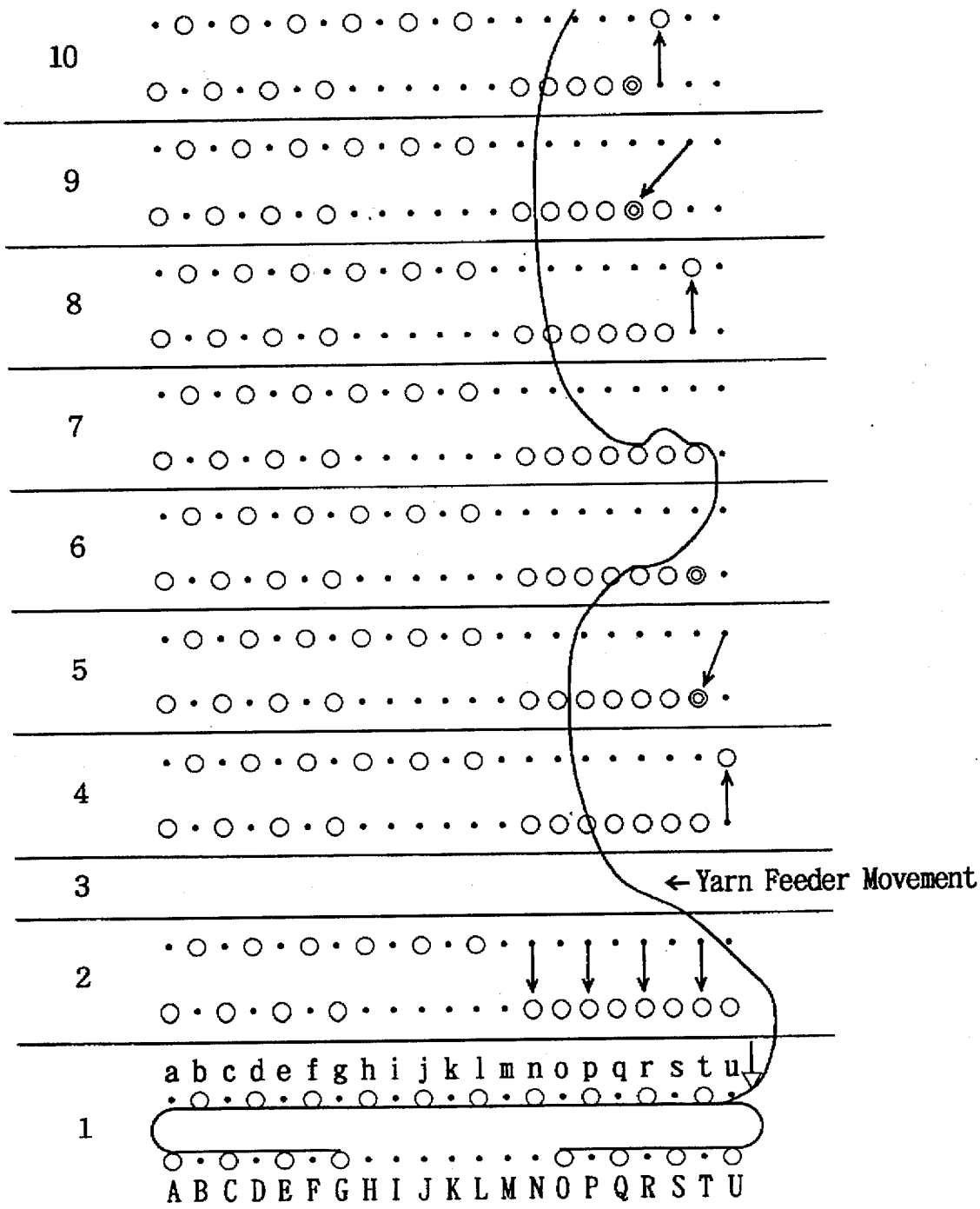
FIG. 12 is a knitting course diagram illustrating the third embodiment.
Figure 13:
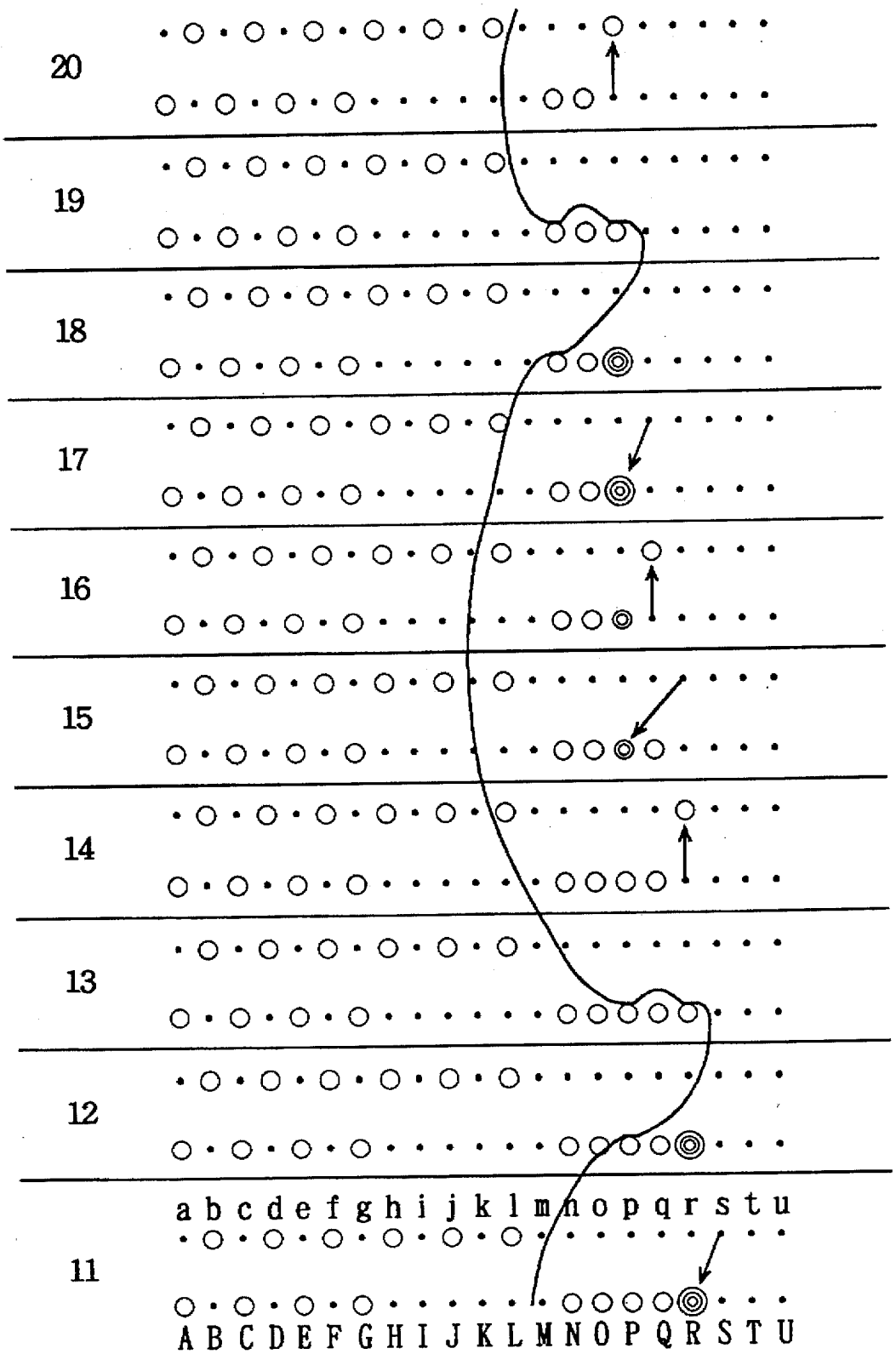
FIG. 13 is a knitting course diagram illustrating the third embodiment.
Figure 14:
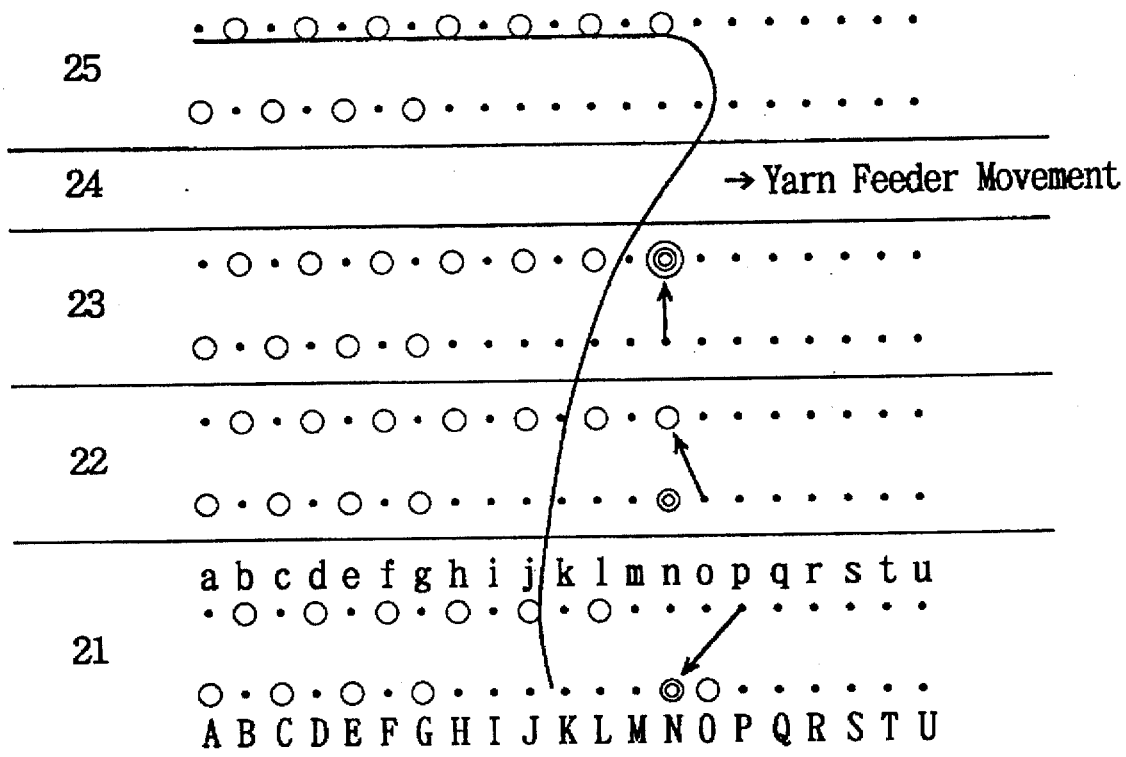
FIG. 14 is a knitting course diagram illustrating the third embodiment.

In the course 2 through the course 5 of FIG. 12 according to the third embodiment, the same knitting as that of the course 15 through the course 18 of the second embodiment is effected. According to the second embodiment, in the course 19, the yarn feeder is shifted to the right, then in the course 20, the yarn is fed to the needles T and R of the front bed. According to the third embodiment, however, in the course 6, when the yarn feeder is shifted to the right, the yarn is fed to the needle R of the front bed to form the stitch 55. On this needle R, is held a stitch of the left back shoulder **6*b*, said stitch being adjacent to the stitch 52 of the left back shoulder 6*b*. The stitch 52 is overlapped with the stitch 51 of the left front shoulder 6*a*. Then in the course 7, in the same manner as the second embodiment, the yarn is fed to the needles T and R of the front bed to form stitches 58 and 56. In the course 8 through the course 23, binding off is effected in the same manner. In the course 25, the course 31 and the course 37 of the second embodiment, the yarn feeder is simply shifted to the right. However, in the course 12 and the course 18 of the third embodiment, while the yarn feeder is shifted to the right, the yarn is fed to the needles P and N to form stitches 55 and 55. The needles P and N hold stitches 54 of the left back shoulder 6*b*, and said stitches 54 are adjacent to the stitch 52 of the left back shoulder 6*b* being overlapped with the stitch 51 of the left front shoulder 6*a*. Then, in the course 24 and the course 25, the same knitting as that of the course 37 and the course 38 of the second embodiment is effected. In the course 24, no knitting is made since all the stitches to be bound off have been overlapped by knitting up to the course 23** (inclusive).

Figure 15:
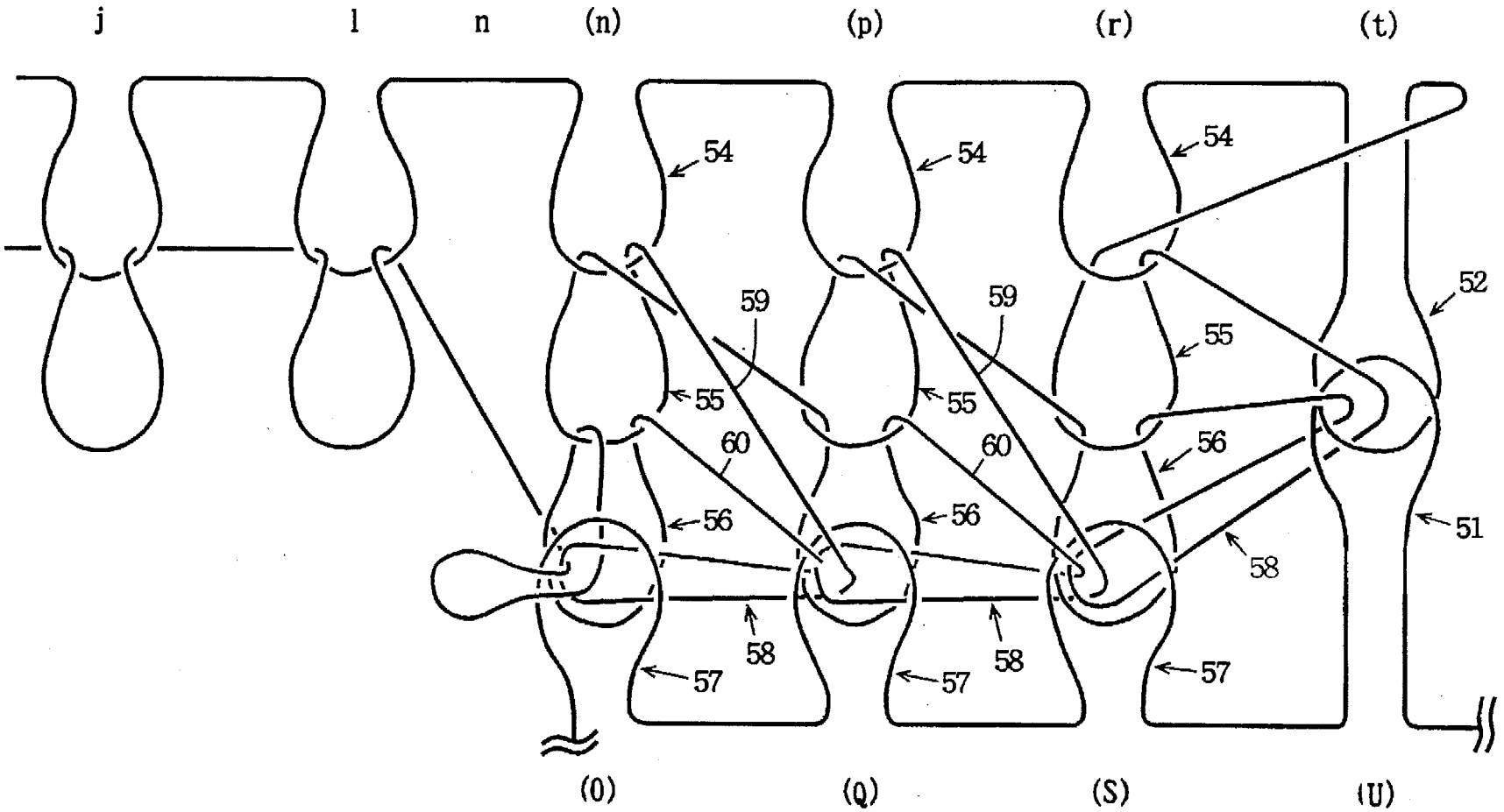
FIG. 15 is a knitted structure diagram illustrating a bound off portion of the pullover 1 bound off according to the third embodiment.
Figure 16:
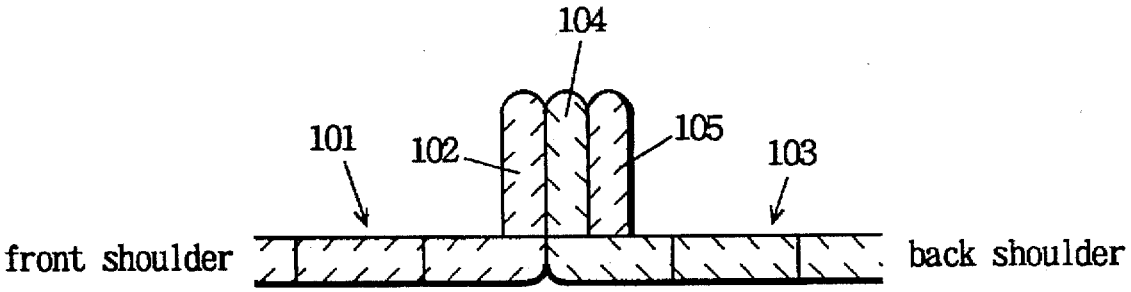
FIG. 16 PRIOR ART
FIG. 16 is a sectional view illustrating a connection bound off by the conventional binding off method.

The knitted structure of the bound off portion upon the completion of the knitting up to the course 25 of the above-mentioned knitting is shown in FIG. 15. As shown in FIG. 15, according to the third embodiment, the stitch 51 of the left front shoulder 6*a* and the stitch 52 of the left back shoulder 6*b*, both being at one end of the left shoulder 6, are identical to the stitch 31 of the left front shoulder 6*a* and the stitch 32 of the left back shoulder 6*b* of the second embodiment. However, in the second through fourth wales from the outer side, in succession to the stitches 54, 54, 54 of the left back shoulder 6*b*, which were transferred onto the needles of the front bed in the course 2, there are stitches 55, 55, 55 formed in the course 6, the course 12 and the course 18, respectively. Furthermore, there are stitches 56, 56, 56, formed on the needle R of the front bed in the course 7, on the needle P in the course 13, and on the needle N in the course 19, respectively. As a result, it is the stitches 56, 56, 56 that are to be overlapped with the stitches 57, 57, 57 of the left front shoulder 6*a*. On the other hand, the stitches 58, 58 and 58 formed on the needle T of the front bed in the course 7, on the needle R in the course 13, and on the needle P in the course 19, respectively, extend to the stitches 57, 56 of the adjacent wales thereof. According to the third embodiment, just like the second embodiment, the stitch 57 of the left front shoulder 6*a* and the stitch 56 of the left back shoulder are overlapped with each other, one set of stitches being placed on the face of the other set. Hence, when the stitch 58 of the next course is formed on the the stitch 57 of the left front shoulder 6*a* and the stitch 56 of the left back shoulder 6*b* being overlapped with each other, the respective stitches will be overlapped one over another, preventing the bound off portion from protruding. The stitch relationship of the triple stitch is back(stitch 54) face/back (stitch 55) face/back (stitch 56) face/back(stitch 58) face/face (stitch 57) back.

The stitch 58 extending to the adjacent wale is concealed under the stitch 57 of the left front shoulder 6*a*, and will not appear on the top surface of the knit fabric. There exist the prolongation 59 extending to the stitch 55 of the left back shoulder 6*b* and the prolongation 60 extending to the stitch 56, both from the stitch 58, which is formed on the stitch 57 of the left front shoulder 6*a* and the stitch 56 of the left back shoulder 6*b* in the overlapped condition. As is the case of the second embodiment, the stitches 55, 56 of the left back shoulder 6*b* are pulled by the prolongations 59, 60 toward the stitch 57 of the left front shoulder 6*a*. Accordingly, the stitch 56 of the left back shoulder 6*b* overlapped with the stitch 57 of the left front shoulder 6*a* will be concealed under the stitch of the left front shoulder 6*a* and the stitch 55 of the left back shoulder 6*b*. As a result, the stitch 57 of the left front shoulder 6*a* and the stitch 55 of the left back shoulder 6*b* will appear to be continuous to each other on the top surface of the knit fabric. Accordingly, the fabric knitted according to the present embodiment is bound off flat in such a way that the bound off portion does not protrude from the knit fabric.

Each of the above-mentioned respective embodiments was described by way of a case using a flat knitting machine with only a pair of one front bed and one rear bed. The present invention, however, can be practiced with a flat knitting machine with four beds, wherein a pair of lower beds, one at the front and one at the rear, are provided with a pair of upper beds, one at the front and one at the rear. In the first embodiment through the third embodiment, knitting is made by using alternate needles as empty needles far transfer. In contrast to them, a flat knitting machine with four beds allows the use of needles of an upper needle bed for transfer. Hence, unlike the first embodiment through the third embodiment, there is no need of provision of empty needles for transfer of stitches. In the present specification, three preferable embodiments were described, but the present invention is not limited in any sense to the embodiments described herein, and various modifications are possible, such as modification of needles on which stitches are to be formed and modification of the sequence of stitch formation.

I claim:

1. A binding off method for binding off stitches of at least two fabrics wherein said at least two fabrics form a tube, said method comprising the steps of:

a: providing a flat knitting machine having at least a first needle bed and a second needle bed, each of said first and second needle beds having a plurality of needles and being slidable relative to each other, said first and second needle beds being configured to hold stitches thereupon, said stitches being transferable between said first and second needle beds;

b: knitting a first knit fabric and a second knit fabric, wherein said first knit fabric corresponds to said first needle bed and wherein said second knit fabric corresponds to the second needle bed, said first knit fabric and said second knit fabric being configured to face each other on said first and second needle beds, respectively;

c: overlapping a stitch of the first knit fabric and a stitch of the second knit fabric by holding at least one first stitch of the first knit fabric on a needle of the second needle bed, holding at least one second stitch of the second knit fabric on a needle of the first needle bed, and holding a third stitch as a binding off stitch on a needle of one of the first and second needle beds, then transferring at least one of said above three stitches between said first needle bed and said second needle bed wherein said first, second and third stitches are alternately overlapped with each other to form a triple stitch, said triple stitch being held on a needle of one of the first and second needle beds;

d: forming a fourth stitch for binding off the triple stitch on the needle of the one of the first and second needle beds upon which the triple stitch is held;

e: removing the triple stitch from the one of the first and second needle beds upon which the triple stitch is held, wherein said first, second, and third stitches of said triple stitch are rotated to suppress a protrusion formed by the binding off of the triple stitch; and f: repeating said steps of c through e.

2. A binding off method for binding off stitches of at least two fabrics wherein said at least two fabrics form a tube, said method comprising the steps of:

providing a flat knitting machine having at least a first needle bed and a second needle bed, each of said first and second needle beds having a plurality of needles and being slidable relative to each other, said first and second needle beds being configured to hold stitches thereupon, said stitches being transferable between said first and second needle beds;

knitting a first knit fabric and a second knit fabric, wherein the first knit fabric corresponds to the first needle bed and the second knit fabric corresponds to the second needle bed, said first knit fabric and said second knit fabric being configured to face each other on said first and second needle beds, respectively;

overlapping a stitch of the first knit fabric and a stitch of the second knit fabric by holding a first stitch of said first knit fabric on a needle of the second needle bed and holding a second stitch of the second knit fabric on a needle of the first needle bed, said first and second stitches being disposed on corresponding ends of the first and second knit fabrics, then transferring at least one of the first and second stitches between the needle beds, thereby overlapping the first and second stitches with each other;

forming a third stitch for binding off the overlapped first and second stitches;

overlapping said third stitch with a fourth stitch of said first knit fabric adjacent said first stitch thereof, and with a fifth stitch of the second knit fabric adjacent said second stitch thereof by holding the fourth stitch on a needle of the second needle bed, holding the fifth stitch on a needle of the first needle bed, and then transferring at least one of said third, fourth and fifth stitches, thereby forming a first triple stitch;

forming a sixth stitch for binding off the first triple stitch; and removing said first triple stitch from a one of said first and second needle beds holding said first triple stitch wherein said first triple stitch is turned to suppress a protrusion formed thereby.

3. A binding off method as recited in claim 2, further comprising the steps of:

forming a second triple stitch by overlapping the sixth stitch with a seventh stitch adjacent said first triple stitch on the first knit fabric, and an eighth stitch adjacent the first triple stitch on the second knit fabric by holding the seventh stitch on a needle of the second needle bed, holding the eighth stitch on a needle of the first needle bed, and then transferring at least one of said sixth, seventh, and eighth stitches, thereby forming the second triple stitch;

forming a ninth stitch for binding off the second triple stitch; and sequentially repeating the steps of forming the second triple stitch and the ninth stitch to form a plurality of second triple stitches.

4. A binding off method as recited in claim 3, wherein a plurality of stitches of the second knit fabric are formed and held on needles of the first needle bed.

5. A binding off method as recited in claim 2, wherein the first, second and third stitches of the triple stitch are arranged such that the third stitch is disposed at one of an innermost stitch position or a middle stitch position of the triple stitch.

6. A binding off method as recited in claim 2, wherein at least one of the first and second stitches is formed as a twisted stitch.

7. A binding off method as recited in claim 3, wherein the step of forming the second triple stitch includes transferring the sixth stitch of the first knit fabric to the second needle bed, and transferring the seventh stitch of the second knit fabric to the first needle bed, then overlapping the sixth and seventh stitches with the eighth stitch, then forming the ninth stitch.

* * * * *